United States Patent [19]

Soliman

[11] Patent Number: 4,836,280

[45] Date of Patent: Jun. 6, 1989

[54] METHOD OF EVALUATING SUBSURFACE FRACTURING OPERATIONS

[75] Inventor: Mohamed Y. Soliman, Lawton, Okla.

[73] Assignee: Halliburton Company, Duncan, Okla.

[21] Appl. No.: 102,406

[22] Filed: Sep. 29, 1987

[51] Int. Cl.[4] ..... E21B 47/06

[52] U.S. Cl. ..... 166/250; 166/308; 73/155

[58] Field of Search ..... 166/250, 305.1, 308; 73/151, 155

[56] References Cited

U.S. PATENT DOCUMENTS

| | | | |
|---|---|---|---|
| 4,192,182 | 3/1980 | Sylvester | 73/155 |
| 4,372,380 | 2/1983 | Smith et al. | 166/250 |
| 4,393,933 | 7/1983 | Nolte et al. | 166/250 |
| 4,398,416 | 8/1983 | Nolte | 73/155 |
| 4,453,595 | 6/1984 | Lagus et al. | 73/155 X |
| 4,577,689 | 3/1986 | Dotson | 166/250 |
| 4,660,415 | 4/1987 | Bouteca | 166/250 X |

OTHER PUBLICATIONS

Determination of Fracture Parameters from Fracturing Pressure Decline by Kenneth G. Nolte, pp. 1-11, Sept. 1979.

*Primary Examiner*—Bruce M. Kisliuk

*Attorney, Agent, or Firm*—Arnold, White & Durkee

[57] ABSTRACT

A method of performing a mini-frac operation wherein the effects of the compressibility of the fracturing fluid and the increase in fracturing fluid temperature are considered. The mini-fracturing operation is performed and the pressure decline is observed at selected intervals over a determined time period. The observed pressure decline values are adjusted to compensate for fluid compressibility and/or for temperature increase. A correlation term is determined which is utilized to determine parameters of the formation and fracture. The parameters of the fracturing operation are then determined in response to the adjusted pressure decline values. The parameters may be adjusted in response to the compensation for temperature and fluid compressibility either by adjusting the observed pressure decline values and comparing them to a known reference, or by establishing new reference values for the well to be correlated with the observed pressure decline to determine a correlation term.

13 Claims, 1 Drawing Sheet

METHOD OF EVALUATING SUBSURFACE FRACTURING OPERATIONS

BACKGROUND OF THE INVENTION

The present invention relates generally to improved methods for designing fracturing programs for fracturing subsurface formations, and more specifically relates to improved methods for utilizing small scale test fracture operations and analysis, commonly known as "mini-frac" operations, to design subsurface formation fracturing programs.

Mini-frac operations consist of performing small scale fracturing operations utilizing a small quantity of fluid, which typically contains little or no proppant. After the test fracturing operation, the well is shut-in and the pressure decline of the formation is observed over time. The data thus obtained is used in a fracture model to establish parameters to be used in designing the formation fracturing program.

Mini-frac test operations are significantly different from conventional full scale fracturing operations in that only a small amount of fracturing fluid is injected, for example, as little as about 25 barrels, and no significant amount of proppant is typically utilized. The desired result is not a propped formation fracture of practical value, but a small scale, short duration fracture to facilitate collection of pressure decline data in the formation. This pressure decline data will facilitate estimation of formation, fluid and fracture parameters.

A major limitation on the value of conventional methods of mini-frac analysis is that the methods rely on assumptions that the fracturing fluid is both incompressible and isothermal. Conventional techniques thus ignore the significant effects which may be presented by compressibility of the fracturing fluid and by temperature increase of the fracturing fluid. For example, use of conventional mini-frac techniques with the Perkins and Kern model has been found to lead to an error in calculated fluid loss coefficient of up to 100%, and to an error in calculated fracture length of up to 75%. The assumption of an incompressible fracturing fluid may lead to particularly erroneous results where foam is used as a fracturing fluid. When the effects of fluid compressibility and temperature increase are considered, the determined fracture length typically decreases while the determined leakoff coefficient and average fracture width typically increases.

Accordingly, the present invention overcomes the deficiencies of the prior art and provides a new method for mini-frac analysis wherein the compressibility of the fracturing fluid and the increases in fracturing fluid temperature are considered, thereby facilitating the designing of optimal subsurface fractures.

SUMMARY OF THE INVENTION

In accordance with the method of the present invention, a mini-frac operation is performed which includes fracturing a subsurface formation with a selected fracturing fluid. The fracturing fluid will preferably not contain any effective amount of proppant. When the test fracturing operation is completed, the well will be shut-in. The pressure decline of the formation will then be observed over time. Preferably, the pressure decline will be observed at relatively short intervals, for example from intervals of a few seconds to several minutes for a selected period, such as, for example, 10 minutes to 2 hours. Preferably the pressure decline will be observed for a period which is at least twice the injection time of the mini-frac test operation. In one particularly preferred method of practicing the invention, the observed pressure decline values are adjusted to compensate for fluid compressiblity, and preferably also for temperature increase. Preferably, the observed pressure decline values are adjusted for fluid compressibility in response to both the compressibility of the fracturing fluid, either as known or empirically determined, and the average pressure in the well over the time interval from shut-in to final sample. The observed pressure decline values are also preferably adjusted for temperature increase in response to the coefficient of thermal expansion of the fracturing fluid and the measured or estimated increase in temperature of the fracturing fluid over time. These adjusted pressure decline values may then be utilized with existing type curves to determine a correlation term which may then be utilized in conjunction with conventional techniques to determine formation parameters such as the leakoff coefficient, the fracture length, the average fracture width, etc. Alternatively, the present invention contemplates the developing of adjusted type curves for a well which may then be utilized with the observed pressure decline values to establish the correlation term.

DETAILED DESCRIPTION OF PREFERRED EMBODIMENTS

Figure 2:
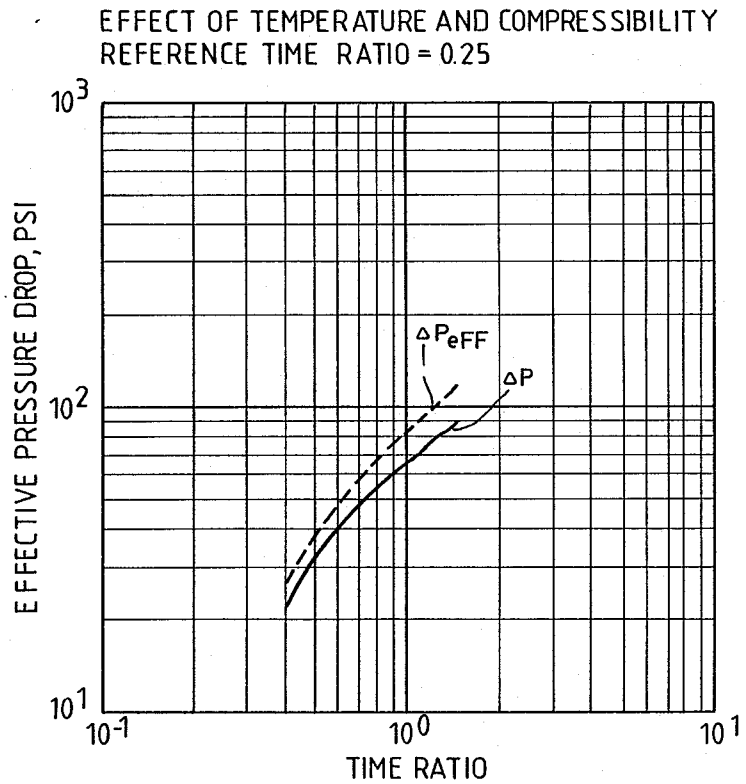
FIG. 2 graphically depicts the change in magnitude and shape between the observed pressure decline curve and the adjusted effective pressure decline curve.

Conventional mini-frac analysis is performed through correlation of both observed data and control data from the mini-frac test operation to type curves functionally related to reservoir performance as modeled by one of several possible fracture models. For example, fractures are modeled on the basis of the Perkins and Kern model, the Christianovich and Zheltov model, the Penny model, etc. By way of example only, the techniques of the present invention will be described herein primarily in reference to the Perkins and Kern model. Those skilled in the art will recognize that the present techniques may be readily utilized with other models.

A particular advantage of methods in accordance with the present invention is that the methods may be practiced in conjunction with existing types of mini-frac analysis. For example, existing techniques of mini-frac analysis include the generation of type curves as set forth above. The observed pressure decline ($\Delta P$) curve, is then plotted. The type curves and the observed data curve are then correlated, either manually or by computer, to determine a "match pressure" ($P^*$). The "match pressure" ($P^*$) is a correlation term which defines the functional relation between type curves representative of the ratio of dimensionless pressure decline to dimensionless time for a selected fracture model and curves representative of the observed pressure drop over time.

The value $P^*$ is then utilized to determine parameters of the fracturing operation which may be utilized to design an optimal full scale fracturing operation. For example, determinations are made of the leakoff coefficient (C) of the formation, the fracture length (L), the fluid efficiency (eff), the average fracture width ($\bar{w}$) and the fracture closure time ($\Delta t_c$) For an example of such conventional techniques, see Nolte, "Determination of Fracture Parameters From Fracturing Pressure Decline," Society of Petroleum Engineers, 1979 (SPE 8341). The disclosure of this publication is incorporated herein by reference to demonstrate the state of the prior art.

The present invention provides an improved method of determining the match pressure (P*). The match pressure as determined in accordance with the present invention is adjusted for the effects of fracture fluid compressibility and temperature change.

One preferred embodiment of the present invention is practiced by adjusting the curve representative of the observed data to compensate for the effects of fluid compressibility and temperature. This preferred method includes determining the "effective pressure drop" ($\Delta P_{eff}$); that pressure which would have been observed if the ideal conditions of fluid incompressibility and isothermal state had existed during the mini-frac test period. In determining the effective pressure drop, the observed pressure decline is adjusted for fluid compressibility in response to both the compressiblity of the fracturing fluid and the average pressure in the well from shut-in to the end of the time period in consideration. The observed pressure decline is also preferably adjusted for increasing temperature in response to the coefficient of thermal expansion of the fracturing fluid and the rate of increase in the fracturing fluid.

The effective pressure drop ($\Delta P_{eff}$) is determined by the relation:

$$\Delta P_{eff} = (1 + C_p P_{avg})\Delta P + \frac{C_T}{\beta_s} \int P(t) \frac{\partial T}{\partial t} dt \quad (1)$$

where:

$C_p$ represents the compressiblity of the fracturing fluid;

$P_{avg}$ represents the average pressure, from shut-in to the end of the evaluation period;

$\Delta P$ represents the measured pressure decline difference for each measured interval;

$C_T$ represents the coefficient of thermal expansion of the fracturing fluid;

$\beta_s$ represents the value of the ratio of the average and well bore pressures while shut-in;

P(t) represents pressure expressed as a function of time;

$(\partial T/\partial)$ represents rate of change of temperature with time; and t represents time variable.

Fluid temperature inside the fracture (T) may be either measured or estimated. Estimation of the temperature change may be done through conventional techniques. For optimal results, however, it is preferred that the temperature be monitored by instrumentation in the wellbore.

Figure 1:
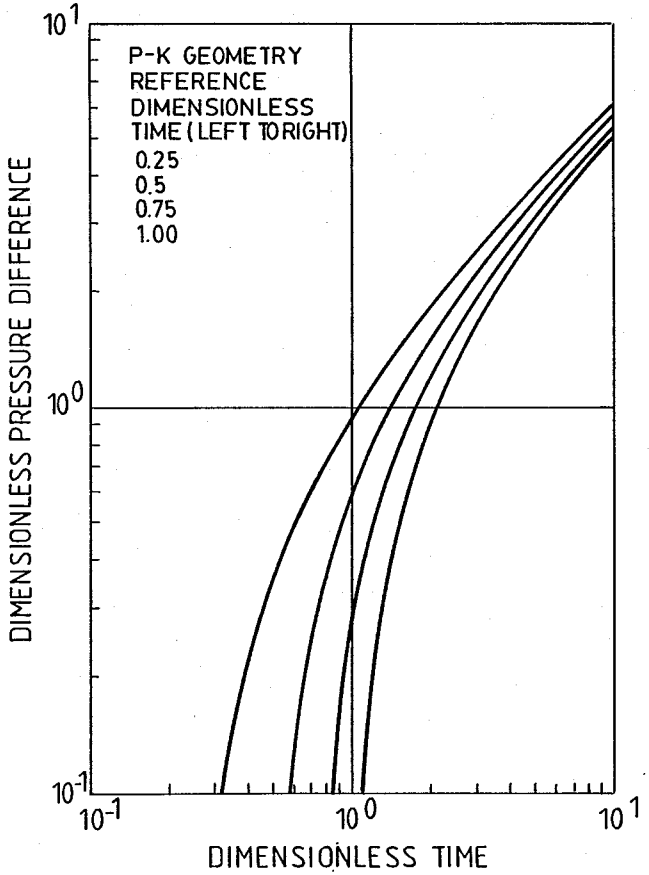
FIG. 1 graphically depicts type curves used with conventional techniques for determining the match point for computation of the leakoff coefficient or other parameters through mini-frac analysis.

Each value, $\Delta P_{eff}$ as a function of time is then plotted to establish a $\Delta P_{eff}$ used in connection with existing type curves, as depicted in FIG. 1 to determine P*. FIG. 2 graphically depicts the difference in magnitude and shape between the observed pressure decline curve (depicted in solid line) and the effective pressure decline curve (depicted in dashed line). The $\Delta P_{eff}$ curve is used in place of the conventional $\Delta P$ curve to make the P* determination. For example, if done manually, the plotted $\Delta P_{eff}$ curve is aligned on the ordinate axis with conventional type curves for the model being utilized, both curves being in the same scale, and the $\Delta P_{eff}$ curve is moved vertically until the two curves most closely match. At that point, the type curve graph ordinate value which is aligned with the baseline of the $\Delta P_{eff}$ curve graph represents the value P*.

The value P* may also be determined automatically, such as by computer. For example, P* may be determined from the relation:

$$\log \Delta P(\delta_o,\delta) = \log \frac{CH_pE'\sqrt{t_o}}{H^2\beta_s} + \log G(\delta_o,\delta) \quad (2)$$

where:

$G(\delta,\delta_o)$ represents the dimensionless pressure difference function as determined by:

$$G(\delta,\delta_o) = \frac{4}{\pi}[g(\delta) - g(\delta_o)] \quad (3)$$

where:

$$g(\delta) = \frac{4}{3}[(1+\delta)^{3/2} - \delta^{3/2} - 1] \quad (4)$$

and:

$\delta$ represents dimensionless shut-in time ($\Delta t/t_o$); and $\delta$ represents dimensionless reference shut-in time for pressure differences.

A graphic plot of log $\Delta P$ ($\delta_o,\delta$) versus log G ($\delta_o,\delta$) yields a straight line which, ideally, has a slope of 1. The line has an intercept.

$$\log\left[\frac{CH_pE'\sqrt{t_o}}{H^2\beta_s}\right] \quad (5)$$

Where the plotted line has slope of 1, or any acceptably close deviation (preferably 1% or less), the intercept represents P*. Conventional computer techniques may be utilized to determine G ($\delta_o,\delta$) and $\Delta P$ for each observed pressure decline value. Through regression analysis the determined values of G ($\delta_o,\delta$) and $\Delta P$ may then be utilized to determine the slope and intercept of a straight line equation fitting these determined values. Preferably, the slope will be determined for a variety of reference times, for example, 20 reference times from 0.25 to 1. The straight line equations for these reference times which yield a slope of 1 will have intercepts representative of P*.

The value P* may then be utilized in a conventional manner to determine the leakoff coefficient by the relation:

$$C = \frac{P^*H^2\beta_s}{H_pE'\sqrt{t_o}} \quad (6)$$

where:

H represents the fracture height;

$H_p$ represents the fluid loss height;

E′ represents the plane strain modulus ($E'=E/1-\nu^2$, where E represents Young's modulus and $\nu$ represents Poisson's ratio); and $t_o$ represents pump time.

The value $H_p$, will typically be inferred from well logs. The value E will typically be determined by mechanical property tests on cores, and the value H will typically be determined from post fracture temperature logs or other means.

The fracture length (L) can be determined by the relation:

$$L = \frac{Qt_o}{\pi\left(CH_p\sqrt{t_o} + \frac{H^2\beta_p}{2E'}P\right)} \quad (7)$$

where:

ΔP represents the ratio of average and wellbore pressure while pumping.

The fluid efficiency (i.e., the ratio of the volume of fluid in the fracture at shut-in to the volume pumped), can be determined by first determining the pressure decline ratio (ρ) by the relation:

$$\rho = G(\delta,\delta_o)\frac{\beta_p}{2\beta_s}\ \frac{P}{\Delta P(\delta_o,\delta)} \quad (8)$$

The fluid efficiency may then be determined by the relation:

$$\text{eff} = \frac{\rho}{1+\rho} = \frac{1}{1+1/\rho} \quad (9)$$

The average fracture width is then determined by the relation:

$$w = \pi CH_p\sqrt{t_o}\,(1+\rho)(\text{eff})/H \quad (10)$$

The closure time can then be determined by the relation:

$$\Delta t_c = g^{-1}\left[\frac{\pi\rho}{2}\right](t_o) \quad (11)$$

The parameter values thus obtained for each of the formation, fracture or fluid properties above may then be used to design an optimal subsurface fracturing program.

Referring again to equation 1, it should be understood that it is possible to consider the effect of fluid compressibility without considering the effect of temperature upon the fracture. For example, the term ∂T/∂t may be set equal to zero. Equation 1 then determines $\Delta P_{eff}$ with a correction for only fluid compressibility. When only fracturing fluid compressibility is considered the shape of the generated curve should not change from the existing type curve, but should shift upwardly along the ordinate axis. Accordingly, the match pressure (P*) will change in value. However, where equation 1 is used in its entirety, and temperature change with time is considered, both the magnitude and the shape of the generated $\Delta P_{eff}$ curve will change. Similarly, it is possible to consider the effect of temperature without compressibility. When comressibility of the fracturing fluid ($C_p$) is set equal to zero, Equation 1 will determine $\Delta P_{eff}$ only as a function of temperature.

Example 1

Example 1 demonstrates the significance of the method of the present invention in determining the effective leakoff coefficient ), ($C_{eff}$), the length of the fracture in feet ($2x_f$), the fluid efficiency (η), and the average fracture width ($\overline{w}$).

Table 1 represents the control data and the observed data from the mini-frac test operation.

TABLE 1

| Input Data | |
|---|---|
| Pumping Rate | 6.8 (bpm) |
| Young's Modulus | 2.50 E 06 (psi) |
| Gross Height | 84.0 (ft) |
| Net Height | 15.0 (ft) |
| Pumping Time | 36.0 (min) |
| Time at ISIP | 37.0 (min) |
| ISIP | 7799 (psi) |
| Closure Pressure | 7350 (psi) |
| Fluid Behavior Index (n′) | 0.45 |
| Degradation Factor (a) | 1 |

Table 2 represents the observed pressure decline at periodic times during the test operation.

TABLE 2

| Pressure psi | Time min. |
|---|---|
| 7792 | 41 |
| 7755 | 46 |
| 7735 | 51 |
| 7725 | 55 |
| 7703 | 65 |
| 7695 | 70 |
| 7688 | 75 |
| 7680 | 80 |
| 7673 | 95 |
| 7665 | 90 |

Table 3 depicts the plotted observed pressure (P) at each time and the corrected pressure ($P_{eff}$) as determined in accordance with the relation of equation 1, at each time increment.

TABLE 3

| Time | Pressure, psi (P) | Corrected Pressure, psi ($P_{eff}$) |
|---|---|---|
| 41 | 7792 | 7789 |
| 46 | 7755 | 7748 |
| 51 | 7735 | 7724 |
| 55 | 7725 | 7711 |
| 65 | 7703 | 7683 |
| 70 | 7695 | 7672 |
| 75 | 7688 | 7661 |
| 80 | 7680 | 7650 |
| 85 | 7673 | 7640 |
| 90 | 7665 | 7629 |

Table 4 depicts the difference in the determined values for fluid loss coefficient, fracture length, fluid efficiency and average fracture width for use of conventional techniques, i.e., ignoring the effects of temperature and pressure (Col. 1); when the effects of fluid compressibility, but not temperature are considered (Col. 2), and when the effects of both fluid compressibility and temperature are considered (Col. 3). In this example, a gel was utilized as a fracturing fluid. Because the gel is of relatively limited compressibility, the most dramatic effects are observed when both temperature and compressibility are considered.

TABLE 4

| | (1) | (2) | (3) |
|---|---|---|---|
| $C_{eff}$ ft/$\sqrt{min}$ | 0.00097 | 0.00098 | 0.00137 |
| $2x_f$, ft | 1016 | 1015 | 937 |
| $\eta$, % | 79.8 | 78.7 | 73.6 |
| $\overline{w}$, inc. | 0.154 | 0.154 | 0.154 |

As can be seen from Table 4, when the effects of fluid compressibility and temperature are considered, the determined effective leak-off coefficient increases dramatically. Additionally, the determined fracture length is 79', or approximately 8%, shorter than would otherwise be expected.

As an example of results obtained when other models are utilized, Table 5 depicts the calculated values for each of the above formation and fracture parameters when the method of the present invention is practiced in relation to a formation modeled according to the Christianovich and Zheltov model.

Again, Column 1 depicts the values obtained when the effects of fluids compressibility and temperature are ignored; Column 2 depicts the values for each parameter when the effects of fluid compressibility but not temperature are considered; and Column 3 depicts the values for each parameter when the effects of both fluid compressibility and temperature are considered.

TABLE 5

| | (1) | (2) | (3) |
|---|---|---|---|
| $C_{eff}$ ft/$\sqrt{min}$ | 0.00466 | 0.00468 | 0.00632 |
| $2x_f$, ft | 232 | 232 | 249 |
| $\eta$, % | 79 | 78.9 | 72.7 |
| $\overline{w}$, inches | 0.668 | 0.667 | 0.640 |

As can be seen from Table 5, when the formation is modeled according to the Christianovich and Zheltov model, and both fluid compressibility and temperature are considered, then the effective leakoff coefficient is increased by approximately 35%. Additionally, the determined fracture length is 17', or approximately 7%, longer than would otherwise be expected; while the average fracture width is reduced by approximately 4%.

Referring again to Equation 1, it has been found desirable to compensate for the effects upon the fracture which may be presented by the volume of fracturing fluid in the wellbore. Because the fracturing fluid in the wellbore is exposed to compression and temperature change, the volume of fluid in the wellbore may cause the fracture to respond as if the fracturing fluid inside the fracture had an increased compressibility and an increased coefficient of thermal expansion. Accordingly, it is desirable to calculate an effective fracturing fluid compressiblity ($C_{P-eff}$), and an effective coefficient of thermal expansion ($C_{T\text{-}eff}$) These terms may be utilized in Equation 1 in place of terms $C_P$ and $C_T$, respectively. The effective fluid compressibility may be determined by the relation:

$$C_{P\text{-}eff} = \left[1 + \frac{V_{wellbore}}{V_{frac}}\right] C_P \tag{12}$$

where:

$V_{wellbore}$ represents the volume of the wellbore exposed to the fracture; and $V_{frac}$ represents the volume of the fracture.

Similarly, the effective coefficient of thermal expansion may be determined by the relation:

$$C_{T\text{-}eff} = \left[1 + \frac{V_{wellbore}}{V_{frac}}\right] C_T \tag{13}$$

The volume of the fracture in Equations 12 and 13 may be estimated from an estimated efficiency and the known pumping time. After he efficiency for the fracturing operation is determined in accordance with Equation 9, if there is a substantial difference between the calculated efficiency and the efficiency assumed for the determination of $V_{frac}$, it is desirable to recalculate the fracture volume $V_{frac}$), on the basis of a revised efficiency estimate. One or more iterations of the method described above may be performed until the estimated efficiency utilized to determine the fracture volume, approximates or equals the efficiency determined in accordance with Equation 9.

An alternative method of practicing the present invention allows for the observed pressure decline difference ($\Delta P$) to be utilized rather than the adjusted value, (i.e., the effective pressure difference ($\Delta P_{eff}$)) In this alternative method, a new type curve is generated for each mini-frac operation. This new type curve is then used to determine P*. The corrected type curve, therefore, contains the adjustment for the effects of fluid compressibility and temperature. The new type curve may be generated as follows:

Equation 9 represents the mass balance equation for the fracture during the shut-in period.

$$O = \frac{2CH_p}{t - t(z)} + \frac{dA}{dt} - \frac{dv}{dt} \tag{14}$$

where:

t(z) represents time at fracture length z; and

A represents the cross-sectional area of the

The correction factor, (dv/dt) may be determined by the $$\frac{dv}{dt} = -C_p V \frac{dP}{dt} \tag{15}$$

where:

$$V = \frac{\pi}{4} WH \tag{16}$$

$$= \frac{\pi H^2}{2E'} P \tag{17}$$

where: W represents the maximum fracture width at the wellbore.

Equation 15 represents a modified compressibility equation. Equation 15 defines the change of pressure as volume is withdrawn from a chamber of fixed volume. Equation 16 describes the fraction volume per unit length at a point in the fracture. Equation 17 again defines the fracture volume per unit length at a point in the fracture expressed in terms of Perkins and Kern geometry, i.e., the $$\frac{2HP}{E'}$$

is substituted for W.

Final formulation of the problem is achieved by the relation:

$$\frac{\pi H2}{2E'}(1 + C_pP)\beta_s\, dP = \frac{2CH_p}{\sqrt{t_o}} f(t)dt \tag{18}$$

By integrating both sides of Equation 18, the following relations are established:

$$\frac{\pi H^2}{2E'}\Delta P(1 + \tfrac{1}{2}C_P(P_1 + P_2)) = \frac{2EH_p}{\sqrt{t_o}}\int f(t)dt \tag{19}$$

where:

$P_1$ represents the shut-in pressure;

$P_2$ represents the final pressure; and where:

$$f(t) = \frac{\sqrt{t_o}}{L}\int_o^L \frac{dz}{\sqrt{t - T(z)}} \tag{20}$$

and:

z represents a variable distance down the fracture;

Y represents the time of the fracture creation at each point (z);

and:

$$\frac{\pi}{2}\,\frac{H^2(1 + C_pP_{avg.})}{E'}\Delta P = \frac{2CH_p}{\sqrt{t_o}}\int f(t)dt \tag{21}$$

The solution, Equation 22, facilitates the determination of ΔP:

$$\Delta P = \frac{CH_pE'\sqrt{t_o}}{H^2\beta_s(1 + C_pP_{avg.})}G(\delta, \delta_o) \tag{22}$$

ΔP, as established through use of Equation 22 compensates only for fluid compressibility.

Where the effects of both fluid compressibility and temperature are to be considered, the following relation is utilized:

$$\frac{\pi H^2}{2E'}(1 + CP)\beta_s\frac{dP}{dt} + \frac{\pi}{2}\,\frac{H^2}{E'}PC_t\frac{\partial T}{\partial t} = \frac{2CH_p}{\sqrt{t_o}}f(t) \tag{23}$$

where:

$C_t$ represents the thermal expansion coefficient.

Equation 23 may be rewritten as follows:

$$\frac{H2\beta_s}{H_pE'\sqrt{t_o}}[(1 + C_pP_{avg.})\Delta P + \int C_t F_2(t) F_3(t)dt] = \frac{4t_o}{\pi}\int f(t)dt \tag{24}$$

where:

$$f_2(t) = \frac{\partial T}{\partial t} \tag{25}$$

-continued $$f_3(t) = P \tag{26}$$

From thermal recovery data the rate change of temperature as a function of time may be determined and pressure may be expressed as a function of time as follows:

Equations 25 and 26 are derived from thermal recovery data.

Equation 24 may then be rewritten as follows:

$$P_D = G(\delta, \delta_o)$$

where:

$$P_D = \frac{H^2\beta_s\,\Delta P_{eff}}{CH_pE'\sqrt{t_o}} \tag{28}$$

and $$G(\delta, \delta_o) = \frac{4}{\pi}(g(\delta) - g(\delta_o)) \tag{29}$$

Value $P_D$ is then plotted versus $\Delta t/t_o$ to establish type curves for use in the determination of P*. The determined of P* from these revised type curves then facilitates determination of the formation and fracture parameters in the manner previously described herein.

It will typically be preferable to perform the determinations and comparisons described herein through use of an appropriately programmed computer. The programming of an appropriate computer to determine parameters according to the realtions described herein or their equivalents will be within the skill of those skilled in the art.

Many modifications and variations may be made in the techniques and structures described and illustrated herein. Accordingly, it should be readily understood that the described and illustrated and embodiments are illustrative only and are not to be considered as limitations upon the present invention.

I claim:

1. A method of determining parameters of a subsurface operation fracturing an earth formation, comprising:

fracturing said formation with a fracturing fluid;

determining a first pressure decline value representative of the observed pressure decline of said fractured formation over a time interval, said first pressure decline value functionally related to the properties of said fracturing fluid during said fracturing of said formation;

determining a second pressure decline value representative of the pressure decline which should have been observed if said fracturing fluid was incompressible; and determining said parameters of said fracturing operation in response to said second pressure decline value.

2. The method of claim 1, wherein said determined parameter of said fracturing operation comprises the leakoff coefficient of said fracturing fluid in said formation.

3. The method of claim 1, wherein said determined parameter of said fracturing operation comprises the fluid efficiency during said fracturing operation.

4. The method of claim 1, wherein said determined parameter of said fracturing operation comprises a fracture dimension formed during said fracturing operation.

5. A method of determining parameters of an operation fracturing a subsurface formation, comprising:

fracturing said formation with a fracturing fluid;

determining a first pressure decline value representative of the observed pressure decline of said fractured formation over a time interval, said first pressure decline value functionally representative of the properties of said fracturing fluid during fracturing of said formation;

determining a second pressure decline value representative of the pressure decline which should have been observed if said fracturing fluid was isothermal; and determining said parameters of said fracturing operation in response to said second pressure decline value.

6. A method of determining parameters of a subsurface fracturing operation in a formation, comprising:

fracturing said formation with a fracturing fluid;

determining a first pressure decline value representative of the observed pressure decline over a plurality of time intervals, said first pressure decline value inherently reflecting the effects of fluid compressibility and thermal expansion on said fracturing fluid;

determining an adjusted pressure decline value representative of the pressure decline value which should have been observed during said time intervals if said fracturing fluid was incompressible and isothermal; and determining said parameters of said fracturing operation in response to said adjusted pressure decline values.

7. The method of claim 6, wherein said determined parameter of said fracturing operation comprises the leakoff coefficient of said fracturing fluid in said formation.

8. The method of claim 1, wherein the determined parameter of said fracturing operation comprises the fluid efficiency during said fracturing operation.

9. The method of claim 1, wherein said determined parameter of said fracturing operation comprises the efficiency of said fracturing operation.

10. A method of anaylzing subsurface formation parameters, comprising:

fracturing a formation with a volume of a fracturing fluid;

measuring the pressure decline of the formation after said fracturing; adjusting said measured pressure decline in response to fracturing fluid compressibility and the coefficient of thermal expansion of said fracturing fluid over a plurality of time intervals; and determining parameters of said formation in response to said adjusted pressure decline values.

11. A method of determining the leakoff coefficient of a subsurface formation exposed to a selected fracturing fluid in response to a selected fracture model, comprising:

obtaining type curves representative of the ratio of dimensionless pressure decline difference to dimensionless time for the selected fracture model;

fracturing said formation with a fracturing fluid; observing the pressure decline values of said formation after said fracturing operation for plurality of time intervals;

adjusting said observed pressure decline values in response to the compressibility of said fracturing fluid and to the temperature increase of said fracturing fluid to establish effective pressure decline values representative of the pressure decline values which should have been observed if said fracturing fluid had been incompressible and isothermal;

functionally relating said effective pressure decline values to said type curves to establish a correlation term; and utilizing said correlation term to determine a parameter of said fracturing operation.

12. The method of claim 11, wherein said correlation term is utilized to determine the leakoff coefficient of the formation during said fracturing operation.

13. The method of claim 11, wherein said correlation term is utilized to determine the efficiency of said fracturing operation.

* * * * *

UNITED STATES PATENT AND TRADEMARK OFFICE

CERTIFICATE OF CORRECTION

PATENT NO. : 4,836,280

DATED : June 6, 1989

INVENTOR(S) : Mohamad Y. Soliman

It is certified that error appears in the above-identified patent and that said Letters Patent is hereby corrected as shown below:

In column 3, line 63, after "to establish a $\Delta P_{eff}$" insert --curve, which is then--.

In column 4, line 34, delete "$\delta$" and in its place insert --$\delta_o$--.

In column 5, line 6, delete "E" and in its place insert --E'--.

In column 5, line 19, delete "$\Delta P$" and in its place insert --$\beta_p$--.

In column 5, line 40, delete "w" and in its place insert --$\bar{w}$--.

In column 8, line 10, delete "he" and in its place insert --the--.

UNITED STATES PATENT AND TRADEMARK OFFICE

CERTIFICATE OF CORRECTION

PATENT NO. : 4,836,280

DATED : June 6, 1989

INVENTOR(S) : Mohamad Y. Soliman

It is certified that error appears in the above-identified patent and that said Letters Patent is hereby corrected as shown below:

In column 8, line 40, after "of the" insert --fracture.--.

In column 8, line 42, after "the" insert --relation:--.

In column 8, line 63, after "the" insert --term--.

In column 9, line 26, delete "Y" and and its place insert --T--.

Signed and Sealed this

Eighth Day of May, 1990

*Attest:*

HARRY F. MANBECK, JR.

*Attesting Officer*

*Commissioner of Patents and Trademarks*